US005902477A

United States Patent [19]

Vena

[11] Patent Number: 5,902,477

[45] Date of Patent: May 11, 1999

[54] COMBINED SEWER OVERFLOW AND STORM WATER DIVERTER SCREEN

[75] Inventor: John Vena, 430 Union Ave., Scotch Plains, N.J. 07076

[73] Assignee: John Vena, Scotch Plains, N.J.

[21] Appl. No.: 08/841,324

[22] Filed: Apr. 30, 1997

[51] Int. Cl.[6] ..... E03F 5/14; E03F 5/10; B01D 35/02; B01D 29/64

[52] U.S. Cl. ..... 210/162; 210/154; 210/106; 210/121; 210/128

[58] Field of Search ..... 210/128, 121, 210/106, 154, 162

[56] References Cited

U.S. PATENT DOCUMENTS

| | | |
|---|---|---|
| 2,339,110 | 1/1944 | Prescott . |
| 3,086,655 | 4/1963 | Compton . |
| 3,477,579 | 11/1969 | Turner . |
| 4,110,216 | 8/1978 | Wagnon et al. . |
| 4,578,188 | 3/1986 | Cousino . |
| 4,857,182 | 8/1989 | Jackson . |
| 5,405,539 | 4/1995 | Schneider . |

FOREIGN PATENT DOCUMENTS

| | | |
|---|---|---|
| 358952 | 8/1989 | European Pat. Off. . |
| 4139572 | 4/1995 | Germany . |
| WO 91/14053 | 9/1991 | WIPO . |

OTHER PUBLICATIONS

Brochure by WasteTech Inc. entitled, CSO Screens –"Mechanically Cleaned Storm Screens".

Brochure by John Meunier entitled, Storm Flow Management –"Low Profile Overflow Screen Model OS–LP".

Brochure by CS Limited entitled, "Automatic Sewage Regulators".

*Primary Examiner*—Thomas M. Lithgow
*Attorney, Agent, or Firm*—Banner & Witcoff, Ltd.

[57] ABSTRACT

A diverter screen for efficiently handling solid and floatable objects in combined sewer overflows and storm water runoff systems is disclosed. The screen is formed of a mechanical bar screen, one or more regulator or overflow chambers, and a deflector plate for diverting the solids and floatables into the outgoing sewage interceptor channel. The bar screen sits on a shelf in a concrete channel, and is sized to capture solids and floatables that must be prevented from entering the rivers, lakes or oceans The bar screen uses a downward rake motion to push solids and some floatables into the outgoing interceptor, while other floatables are allowed to drain out as the regulator channel drains.

10 Claims, 2 Drawing Sheets

COMBINED SEWER OVERFLOW AND STORM WATER DIVERTER SCREEN

BACKGROUND OF THE INVENTION

The present invention generally relates to the field of waste water management and more particularly, is directed to a diverter screen for more efficient handling of solids in combined sewer overflows and storm water runoff.

For many years, municipalities designed their sewer system to accommodate the water run off from storms and heavy rains along with the normal waste water and sewage from homes and commercial establishments. Most of the storm water entered the sewer directly from down spouts on homes and other buildings and from street run off.

Combining storm run off with waste water in this manner was at one time though to be a convenient way of providing a place for the water to be disbursed quickly and prevent large collection pools or puddles from forming. Depending on the adjacent terrain, pools or puddles often would not have a convenient outlet to drain and thus were left to slowly evaporate. The slow process of evaporation leads to stagnation and the attendant health hazzards that stagnate water poses.

While combining storm run off with normal sewage solved many of the storm run off problems, additional urbanization and residential development soon began to burden the sewer system infrastructure, including the waste water treatment plants, of many town and cities. In order to relieve some of the burden, many municipalities began to build separate collection systems for storm water run off. Many other towns and cities simply took steps to prevent storm run off from entering the sewer system altogether.

For many other municipalities, the very high capital cost of building and maintaining a duplicate sewer system for storm run off water makes this approach unavailable. In addition, preventing storm run off from entering the sewer system also has it cost. Thus, many municipalities continued to try to cope with the burdens of a combined storm water run off/waste water system by dealing with the problem at the treatment plant end.

One of the functions of the treatment plant is the removal of solid and floating objects from the waste water before it can be treated and rendered safe for further use or disbursed into a local river, lake or ocean. Storm run off which enters the sewer system greatly increases the number of such objects which are introduced into the system. However, the waste water treatment plant is vulnerable to being deluged with run off water during a major storm.

In order to deal with this problem, current Federal and State regulations allow excess waste water to be diverted around the treatment plant and into local rivers, lakes and oceans during a storm. This is accomplished with the use of regulator or overflow devices in the collection system. More recent regulations require, however, that solid and floating objects of a certain size be removed from the water before it can be allowed to run into the rivers, lakes or oceans.

In order to remove the undesirable solid and floating objects, the prior art teaches the use of separation processing stations outside of the treatment plant for performing a pre-filter of the waste water. The solid objects filtered out as a result of this process must be manually collected and loaded on to transfer trucks for disposal at an appropriate site.

Use of the pre-filter process and collection of the filtered objects adds more cost to the treatment of waste water in terms of added labor and maintenance. Accordingly, there is a need for a more efficient process for removing solid and floating (floatables) objects from waste water.

SUMMARY OF THE INVENTION

The present invention provides an apparatus for diverting to an outgoing sewage interceptor channel, solids and floatables appearing during and after storm events so that the solid and floatables can be conveyed to an associated sewage treatment facility for centralized handling and disposal. The apparatus incorporates a mechanical bar screen, one or more regulator or overflow chambers, and a deflector plate for diverting the solids and floatables into the outgoing sewage interceptor channel. The bar screen sits on a shelf in a concrete channel, and is sized to capture solids and floatables that must be prevented from entering the rivers, lakes or oceans. The bar screen uses a downward rake motion to push solids and some floatables into the outgoing interceptor, while other floatables are allowed to drain out as the regulator channel drains.

Further details of the present invention will be understood from a reading of the detailed description of the drawings.

BRIEF DESCRIPTION OF THE PREFERRED EMBODIMENT

Figure 1:
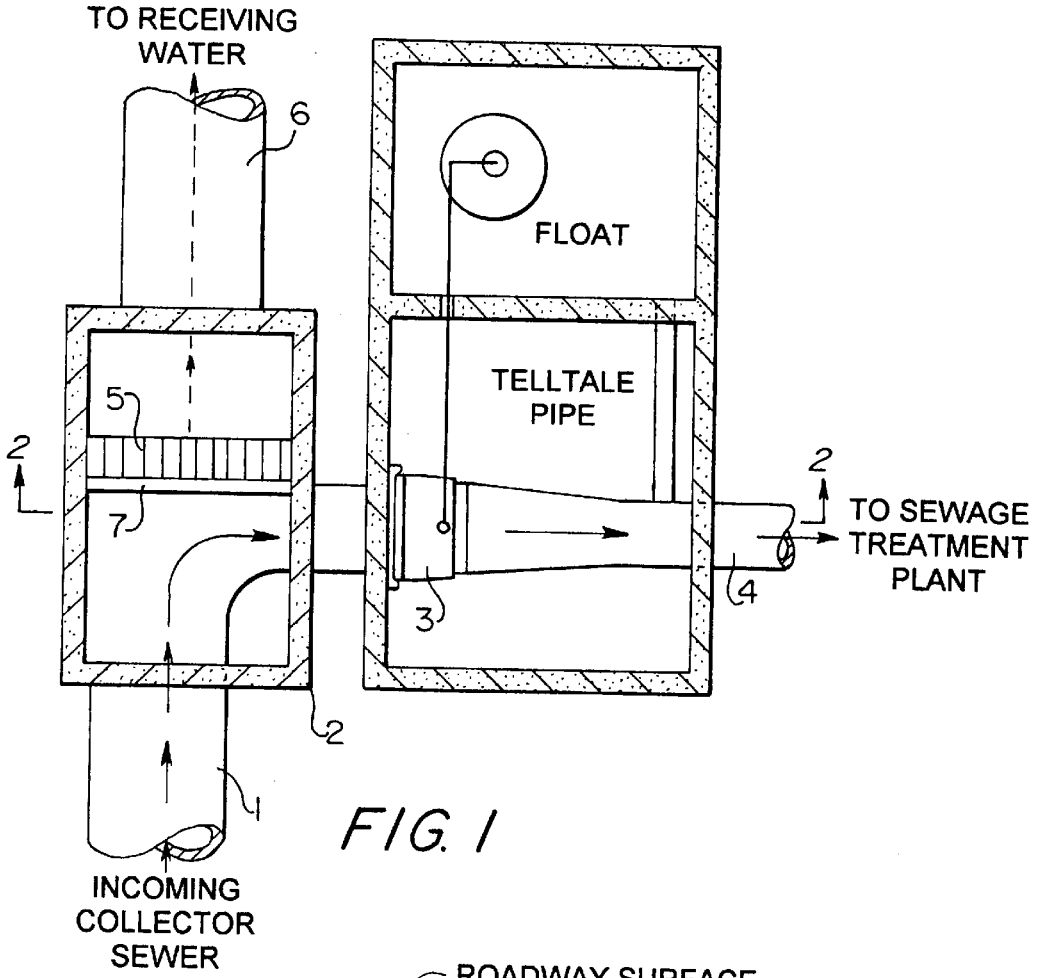
FIG. 1 illustrates the mechanical bar screen of application invention.
Figure 2:
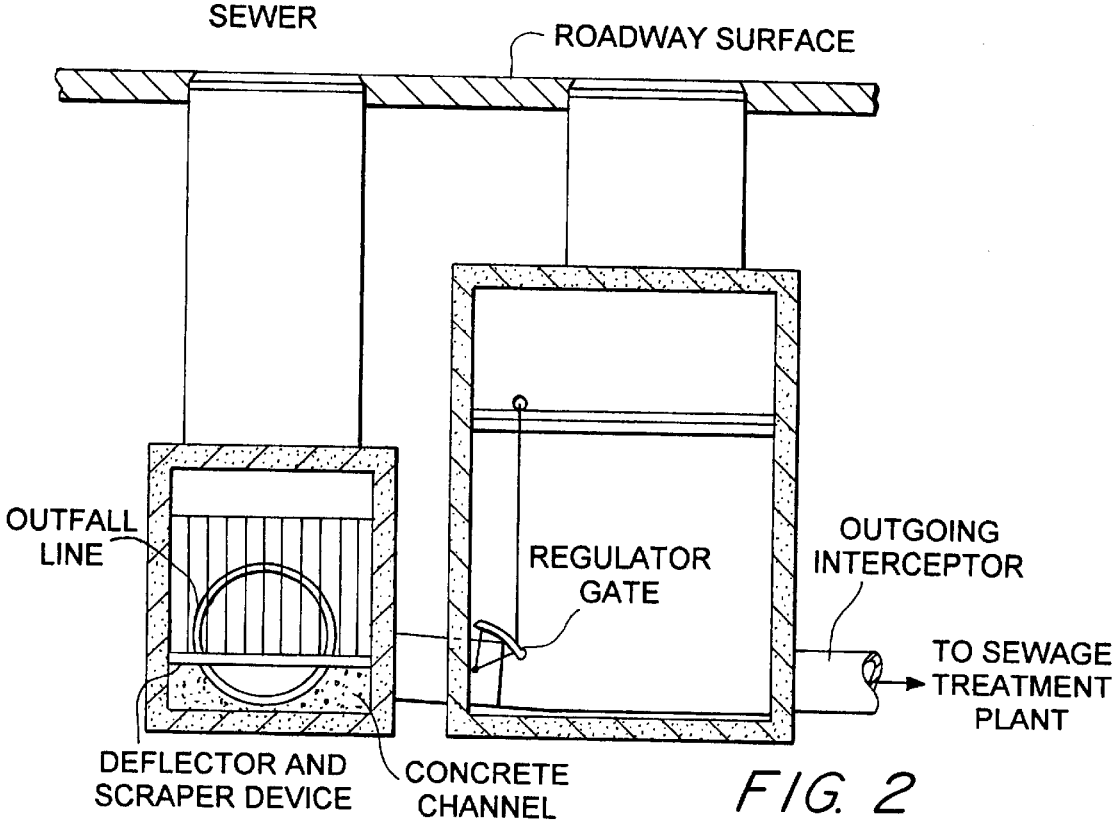
FIG. 2 is cross-section taken alone line A—A in FIG. 1.

FIG. 1 illustrates one embodiment of the mechanical bar screen of Applicant's invention. As FIG. 1 shows, flow from an incoming collector sewer 1 enters a typical regulator or overflow chamber 2. During non-storm operation, the water passes through the regulator device 3 and into outgoing interceptor 4 to the sewage treatment plant. Regulator or overflow device 2 is controlled by a float and gate mechanism, an overflow weir, restricted outlet pipe or other devices that currently exist in collection systems or can be installed for such purposes.

During a rain storm, the portion of the water which represents overflow passes through screen 5 into outfall line 6. The water from outfall line 6 must be filtered to remove solids and floatables as required by current State and Federal regulations. This is accomplished by screen 5.

Screen 5 is designed so that it will block objects larger than the limit specified by State and Federal regulations. A mechanical rake device which is integral to screen 5 serves to clean screen 5 and push any solid objects and floatables which have been trapped by screen 5 into outgoing interceptor 4. A combination deflector plate and scraper 7 assist in diverting raked and incoming solids to the outgoing interceptor 4. The remaining of the floatables will drain out of regulator chamber 2 into outgoing interceptor 4 as the flow subsides. Mechanical rake 5 is controlled by a float switch and will continue to run until regulator chamber 2 is completely drained.

Forcing solids and floatables into outgoing interceptor 4 and into the treatment plant, allows conventional equipment already installed in the plant to separate out the objects as it customarily does during non-storm conditions. Thus, there is no need for a separate filtering and collection process as is now required by the prior art.

As discussed above, the first flush of floatables through the system occurs while the amount of water from incoming collector sewer 1 is below the level required to engage screen 5. Once the level of flow increases to the point where screen 5 is engaged, screen 5 diverts the solids to the treatment facility via regulator 3 and outgoing intercepter 4 by the downward motion of the integral rake arm. Some floatables may get swept by the diverter screen and deflector plate motion but the majority are trapped at the top of screen 5 or float back to the top of the screen before they can exit outgoing intercepter 4 to the treatment plant. Once the storm subsides, the floatables settle into the treatment plant outlet with the natural subsidence of the water level.

The above described two-stage flushing operation results in a spreading out of the solids loading the treatment plant.

Figure 3:
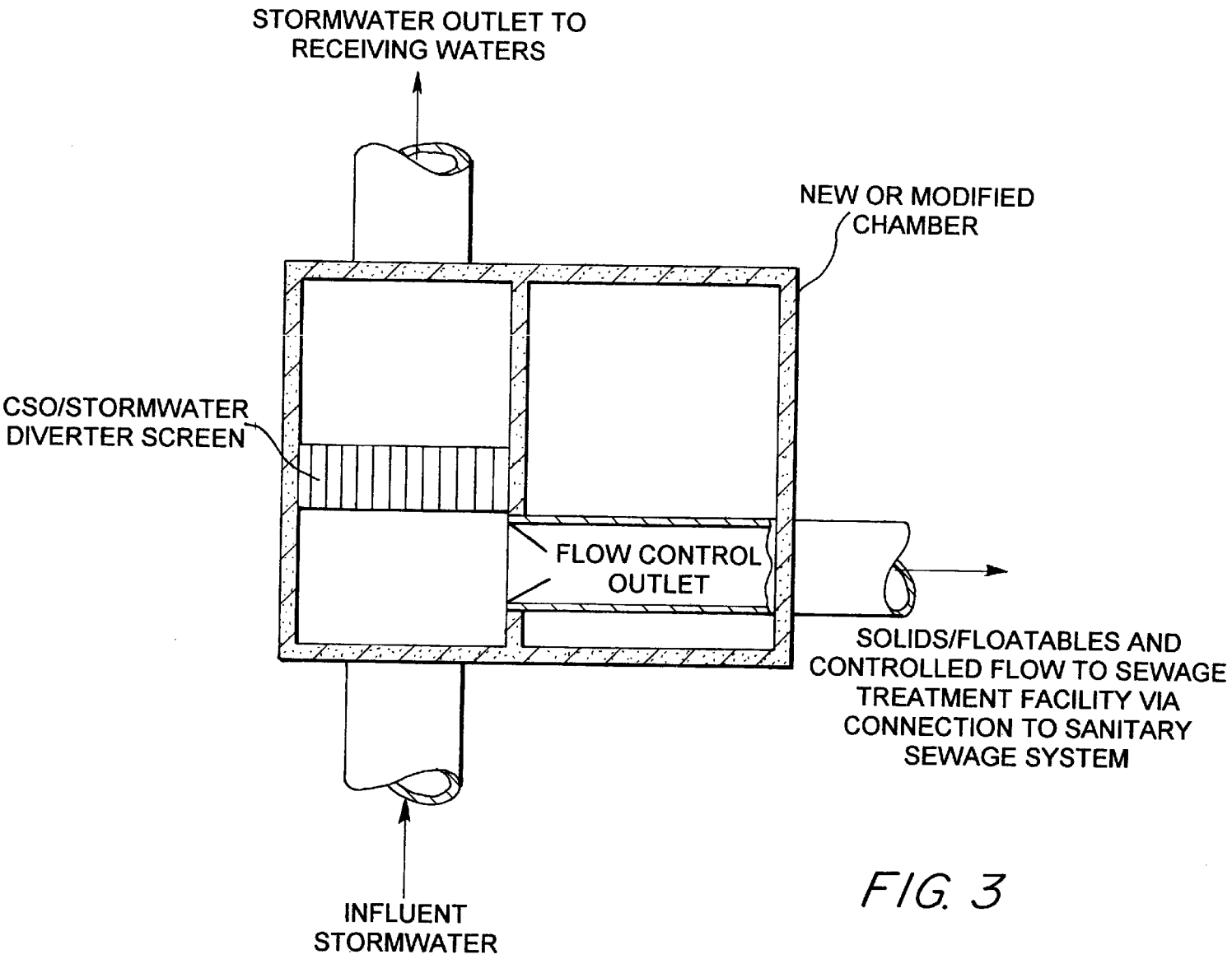
FIG. 3 is an alternative embodiment of the present invention specific to storm water overflows only.

FIG. 3 illustrates another embodiment of the present invention. In this case, the new or modified chamber receives only storm water run off with no sewage component. Diverted solids are piped to a nearby sanitary sewage system for handling at the treatment facility. Outlet storm waters are free of solids and floatables larger than the regulated minimum.

It should be obvious from the above-discussed apparatus embodiment that numerous other variations and modifications of the present invention are possible, and such will readily occur to those skilled in the art. Accordingly, the scope of this invention is not to be limited to the embodiment disclosed, but is to include any such embodiments as may be encompassed within the scope of the claims appended hereto.

I claim:

1. A diverter screen system for use in a waste water management system for directing the flow of solid and floatable objects carried by waste water, wherein said screen system comprises a waste water chamber having an inlet port for receiving waste water, a waste water treatment plant outlet port which communicates directly with said inlet port, an overflow outlet port and a diverter screen positioned in said chamber such that wastewater that rises in said chamber and flows through said upper overflow outlet chamber must first pass through the diverter screen which functions to retain solid and floatable objects of a predetermined size, said diverter screen comprising:

a plurality of spaced apart screening elements cooperating to form a filter, said filter being of a generally slanted form and having a forward lower end positioned closer to said inlet port, and a rearward upper end positioned closer to said overflow outlet port;

a movable rake arm coupled to said filter for directing said solid objects retained by said filter to said waste water outlet port, said movable rake arm being movable about said filter, wherein said floatable objects being allowed to flow to said waste water outlet port when the level of water in said chamber is below a predetermined level.

2. The diverter screen of claim 1, further including a mounting surface, wherein said filter sits on said mounting surface.

3. The diverter screen of claim 2, wherein said mounting surface is formed of a concrete channel.

4. The diverter screen of claim 3, wherein said concrete channel is formed of a size to capture said solids and said floatable objects.

5. The diverter screen of claim 4, wherein said movable rake arm is movable in a generally upward and a generally downward direction.

6. The diverter screen of claim 5, wherein said movable rake arm moves in said downward direction to push said solid objects into said concrete channel.

7. The diverter screen of claim 1, wherein said screening elements are generally bar-shape in construction.

8. The diverter screen of claim 1, further including a liquid level gage for gaging the level of liquid on which said diverter screen is to act, said liquid level gage activating the movement of said movable rake arm when the level of liquid on which said diverter screen is to act reaches a predetermined level.

9. The diverter screen of claim 8, wherein when activated said movable rake arm continues to move until the level of said liquid on which said diverter screen is to act reaches a second predetermined level.

10. The diverter screen of claim 9, wherein said liquid level gage is a float switch.

* * * * *